United States Patent [19]

Graser

[11] 4,330,078

[45] May 18, 1982

[54] ABBREVIATED HEIGHT PARTITION

[75] Inventor: Earl J. Graser, Monroe, La.

[73] Assignee: Manville Service Corporation, Denver, Colo.

[21] Appl. No.: 223,601

[22] Filed: Jan. 9, 1981

[51] Int. Cl.[3] ..... B65D 5/48

[52] U.S. Cl. ..... 229/15; 229/42; 229/28 BC

[58] Field of Search ..... 229/15, 42, 28 BC

[56] References Cited

U.S. PATENT DOCUMENTS

| | | | |
|---|---|---|---|
| D. 221,623 | 8/1971 | Grant | 229/15 |
| 2,792,982 | 5/1957 | Malmgren . | |
| 2,857,089 | 10/1958 | Roche . | |
| 3,211,357 | 10/1965 | Weiss . | |
| 3,263,893 | 8/1966 | Weiss . | |
| 3,283,989 | 11/1966 | DePaul | 229/15 |
| 3,352,473 | 11/1967 | Graser | 229/15 |
| 3,986,658 | 10/1976 | Arneson | 229/28 BC |
| 4,209,125 | 6/1980 | Helms | 229/15 |

*Primary Examiner*—Herbert F. Ross

*Attorney, Agent, or Firm*—Robert M. Krone; Joseph J. Kelly; Norvell E. Von Behren

[57] ABSTRACT

An improved partition structure for a wrap-around beverage carrier is disclosed. The partition structure comprises an elongated longitudinal structure having at least two hinged butterfly elements formed thereon and the structure has at least one hinged tab formed on the bottom edge of the partition structure. The tab extends on opposite sides of the structure for engagement beneath the bottles contained in the carrier. As a result the partition does not have to be glued to the carrier.

6 Claims, 7 Drawing Figures

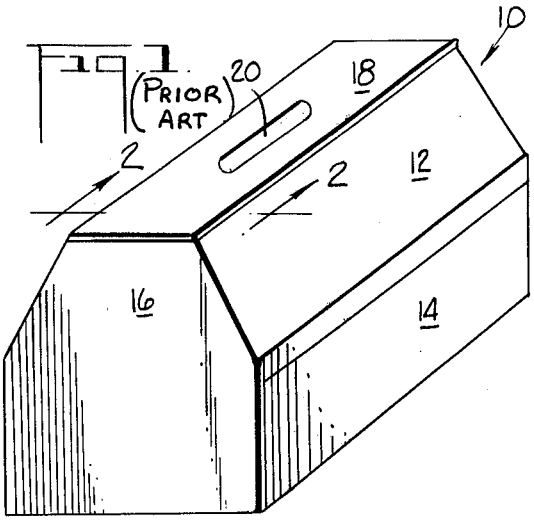
FIG. 1 (PRIOR ART)
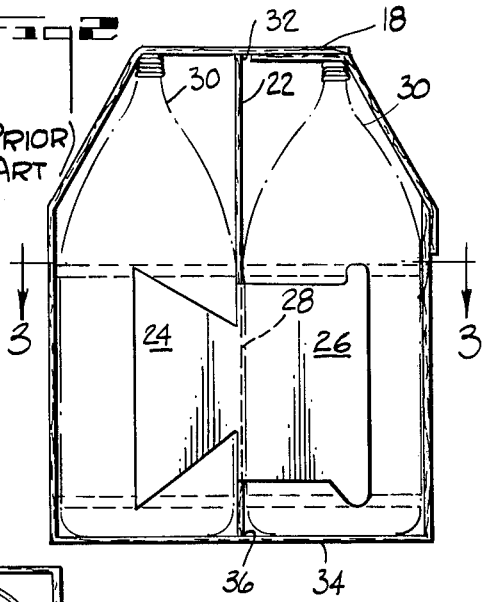
FIG. 2 (PRIOR ART)
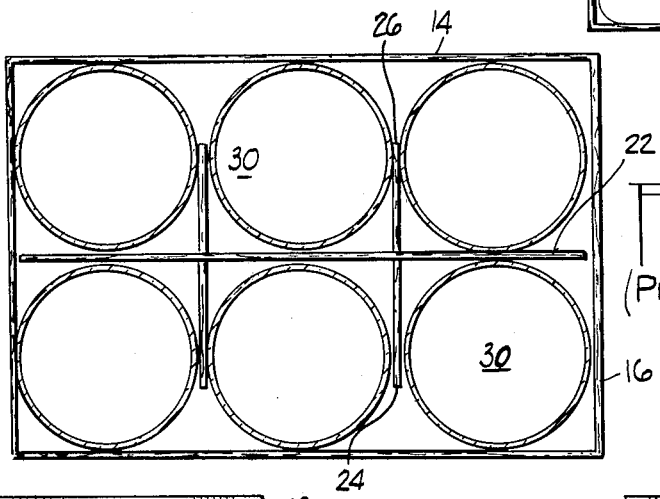
FIG. 3. (PRIOR ART)
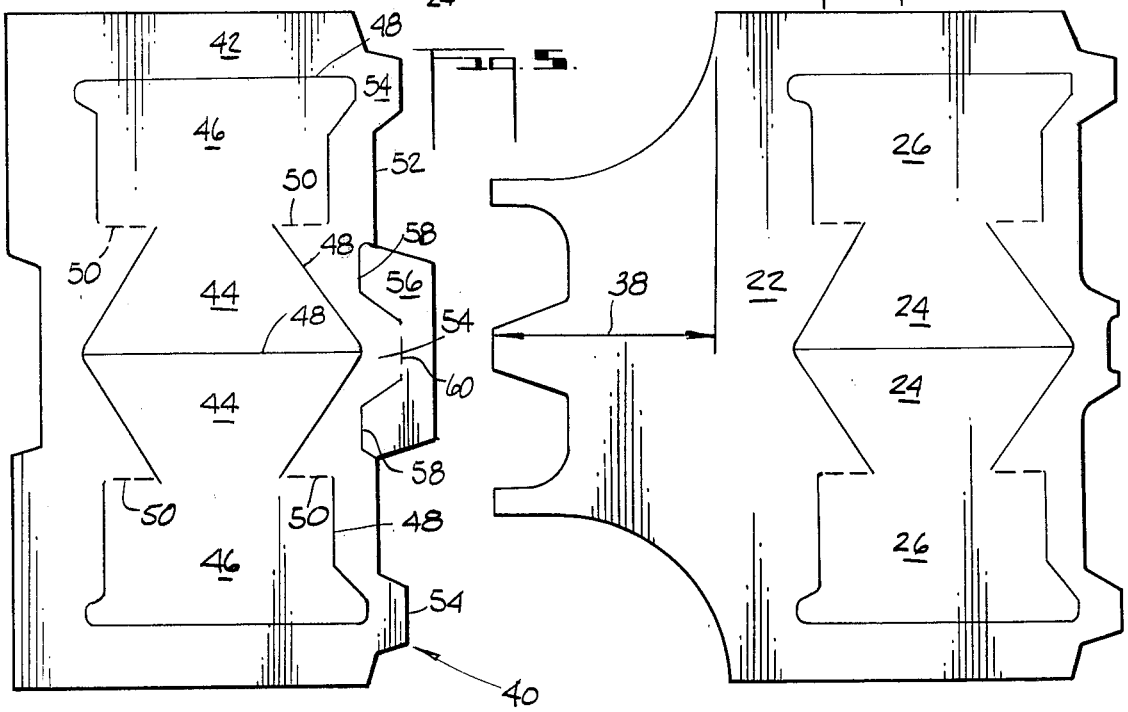
FIG. 4. (PRIOR ART)
FIG. 5.

ABBREVIATED HEIGHT PARTITION

BACKGROUND OF THE INVENTION

This invention relates generally to beverage carriers for a plurality of bottles and more particularly relates to a new and improved abbreviated height partition structure having a unique system of anchoring the structure at the bottom to retain the desired position of the structure blank to separate bottles from contact.

It is known in the art of basket style carriers for beverage bottles to provide a separate partition structure which is insertable into the carrier during the packaging process to separate adjacent bottles from damage. Such partition structures may be adhesively secured to the carrier and may also be loosely positioned within the carrier being held in place by the top panel of the carrier. By referring to the drawing FIGS. 1–4 there is shown a prior art type carrier of the type before-described with the carrier shown generally by the numeral 10 which comprises a sidewall panel 12 and 14 on both sides of the carrier along with an end wall panel 16 also constructed on both sides of the carrier. The bottom of the carrier contains a bottom wall not shown in the drawing FIG. 1 and also a top wall 18 which has a handle opening 20 formed therein. Referring to FIG. 2 of the drawing there is shown a sectional view taken along line 2—2 of FIG. 1 showing how a separate partition structure 22 having at least two hinged transverse butterfly type partition elements 24 and 26 formed thereon and pivotable about the dashed line 28. A plurality of bottles 30 are contained within the carrier 10 and the butterfly partition elements 24 and 26 are used to separate adjacent bottles. From FIG. 2 of the drawing it can be seen that the partition 22 extends to the underside of the top wall panel 18 and is held in place by bearing against the underside at 32 as well as against the underside of the bottom wall panel 34 at 36.

FIG. 3 shows a sectional view taken along line 3—3 of FIG. 2 and shows how the partition structure 22 would be placed between the plurality of bottles.

The prior art partition of the type shown and positioned in FIGS. 1–3 is shown in FIG. 4 of the drawing and it can be seen how the partition would be expensive to manufacture in light of the fact that the upper potion of the partition is used totally to hold the partition within the carrier and especially the area shown by the dimension 38.

It is known also in the prior art as shown in U.S. Pat. No. 3,986,658, issued Oct. 19, 1976 and assigned to Federal Paper Board Company, Inc. to attempt to shorten the partition dimension by the utilization of bottom tabs to hold the partition in place. Such a bottom tab structure is shown in FIG. 6 of the drawing and is defined as a small semi-circular tab 85 which is adapted to hinge on the score line 86 into a plane normal to the plane of the body of the blank 70. The anchoring tab 85 is trapped between the bottom of a bottle and the top face of the inner bottom wall forming panel 27 when the panels 27 and 31 are closed as shown in FIG. 2 of the drawing. In this manner the partition structure is alleged to be anchored so as to prevent it from climbing upward to an inoperative position by means of the turned over tab 85 which is captured between the bottom of a bottle and the interface of the bottom wall.

Several years ago the inventor of the subject application constructed samples of partitions using the tab structure shown in U.S. Pat. No. 3,986,658 and formed a tab folding off of one side of the bottom of the partition as shown in FIG. 6 of the patent drawing. Vibration tests were run on this tab structure to simulate a 1,500 mile trip of the carrier. The partition was inserted in a Marksman 6–12 oz. package for a major brewery using bottles from that major brewery. "Marksman" is the registered trademark of the assignee of the subject patent application. The test results were unacceptable to the inventor of the subject application since the single tab structure did not confine the partition in is desired position at the bottom of the package. With the single tab structure hinged and protruding off to one side of the longitudinal partition, the vibration and give of the package and its movement caused the partition to move upward and unfold the tab enough to cause bottle contact.

SUMMARY OF THE INVENTION

In order to overcome problems encountered with the single tab structure, there has been provided by the subject invention an improved partition structure utilizing at least one hinged tab which is formed on the bottom edge of the partition structure with the hinged tab extending on opposite sides of the structure for engagement beneath the bottles contained in the carrier. By the use of a hinged tab extending on opposite sides of the longitudinal partition, there is provided a wedge that cannot unfold with vibration or movement in the manner that the one side tab structure formerly developed. Vibration tests performed on the applicant's new and novel hinged tab structure shows that a 3,000 mile trip of the carrier can easily be accomplished with the partition holding in place due to the bridging across the center of the longitudinal partition. The reduction of costly material in the area 38 as shown in prior art structures of FIG. 4 has been calculated to be between 40% and 60%, depending on bottle height and shape. The applicant's novel hinged tab is formed in a generally U-shaped configuration which enables balanced wedging of the partition against both adjacent bottles for a positive effect.

Accordingly, it is an object and advantage of the invention to provide a new and novel partition structure which is designed to eliminate excess height in the partition structure formerly used to hold the structure within the carrier.

Another object and advantage of the invention is to provide a new and novel partition structure which is designed to wedge against at least two bottles contained in adjacent cells of the carrier in order that the partition structure will not ride up within the carrier to thereby allow bottle contact.

These and other object and advantages of the invention will become apparent from a review of the drawings and from a reading of the description of the preferred embodiment.

DESCRIPTION OF THE DRAWINGS

FIG. 1 is a perspective view of a prior art carrier of the type utilizing both prior art partition structures and the applicant's new and novel partition structure;

FIG. 2 is a sectional view taken along line 2—2 of FIG. 1 showing a prior art partition inserted into a carrier of the type shown in FIG. 1;

FIG. 3 is a sectional view taken along line 3—3 of FIG. 2 showing the prior art type partition inserted between a plurality of six bottles in the beverage carrier;

FIG. 4 is a plan view of a prior art partition showing a full height partition which is used to contain the partition within the carrier of the type shown in FIG. 1;

FIG. 5 is a plan view of the applicant's new and novel abbreviated height partition shown in comparison to the prior art partition of FIG. 4;

DESCRIPTION OF THE PREFERRED EMBODIMENT

Figure 6:
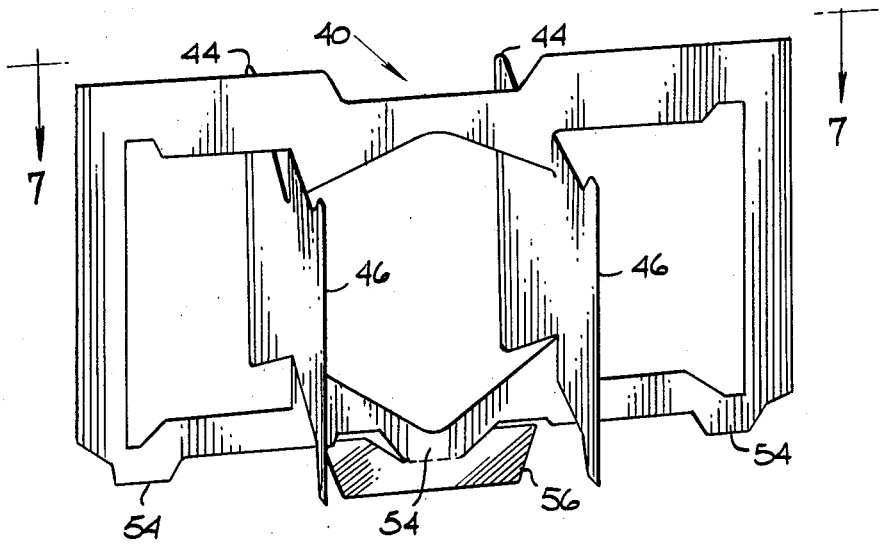
FIG. 6 is a perspective of the applicant's new and novel abbreviated height partition structure showing the transverse partition elements or butterfly partitions folded out 90° as the partition structure would be upon positioning in the carrier of the type shown in FIG. 1.

Referring now to FIG. 5 of the drawings there is shown a preferred embodiment of the applicant's new and improved partition structure shown generally by the numeral 40 which comprises an elongated longitudinal partition structure 42 having at least two hinged transverse butterfly-type partition elements 44 and 46 formed therein. The transvere partition elements 44 and 46 are formed in the longitudinal structure 42 by means of a plurality of die cuts 48 and a plurality of cut-score lines 50 about which the butterfly elements 44 and 46 hinge.

In the preferred embodiment of the applicant's partition it is noted that the partition has four hinged transverse partition elements 44 and 46 suitable for utilization in a wrap around style carrier capable of transporting six bottles. It is within the spirit and scope of the invention that the carrier would also be designed to transport four bottles, in which case the applicant's partition structure would contain at least two hinged transverse partition elements 44 and 46 to separate four bottles.

Formed on the bottom edge 52 are a plurality of downwardly extending feet 54 with the applicant's new and improved hinged tab 56 being formed on the middle foot 54. The hinged tab 56 is formed by the use of a plurality of die cuts 58 in combination with a cut-score line 60 about which the hinged tab 56 pivots.

Figure 7:
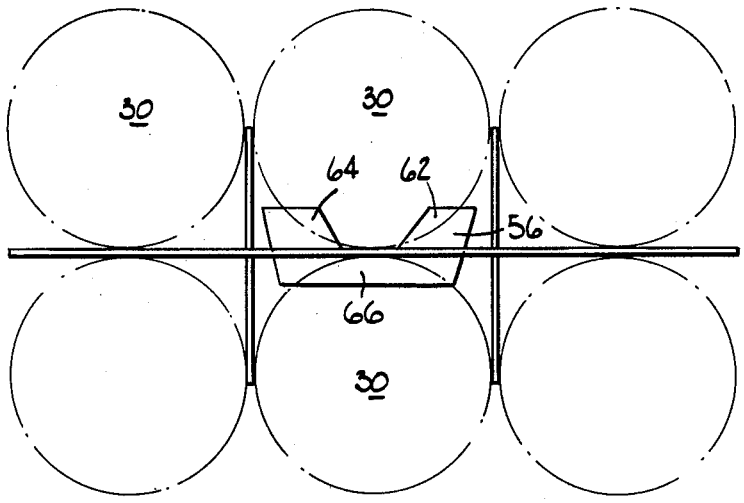
FIG. 7 is a sectional view taken along line 7—7 of FIG. 6 showing the applicant's preferred embodiment of the partition structure inserted within a plurality of six bottles and showing the hinged tab positioned under adjacent central bottles in the preferred embodiment.

Referring now to FIG. 6 of the drawing there is shown the applicant's new and improved partition 40 showing the butterfly partition elements 44 and 46 pivoted 90° as they would be prior to placement of the partition 40 within a beverage carrier. It can also be seen how the hinged tab 56 has been pivoted 90° out of the plane of the production blank for the partition 40 and as the hinged tab 56 would be resting on the bottom panel of whatever carrier the partition were utilized with. The positioning of the hinged tab 56 is also shown in FIG. 7 of the drawing which shows a plurality of bottles 30 positioned within a carrier with the hinged tab 56 being positioned underneath adjacent bottles 30 in the carrier. For example, the preferred embodiment of the hinged tab 56 would be in a generally U-shaped configuration with two depending legs 62 and 64 being positioned under one bottle while the remaining portion 66 would be positioned under the adjacent central bottle. With this structure can be seen that the two central bottles 30 then firmly anchor the partition 40 in place within the carrier, thus eliminating the tendency of the partition to ride up in the carrier during vibration caused in a transit situation.

It is within the spirit and scope of the invention that the abbreviated height partition could have more than one hinged tab 56 formed on the bottom of the partition and could have a hinged tab 56 formed on each of the feet 54 if it was desired by the purchaser of the partition.

From the foregoing it can be seen that there has been provided by the subject invention a new and novel partition structure which eliminates the problems previously mentioned that were encountered with prior art type structures. It is also apparent that many changes may be made in various parts of the applicant's invention without departing from the spirit and scope of the invention and that applicant's invention is not to be limited to the exact structure shown, which has been shown by way of illustration only.

Having described my invention, I claim:

1. An insertable vertical abbreviated height partition for a wrap-around beverage carrier for a plurality of bottles positioned in adjacent cells of the carrier, comprising:

(a) an elongated longitudinal partition structure having at least two hinged transverse partition elements formed therein; and (b) a hinged tab formed on the bottom edge of the elongated longitudinal partition structure and extending on opposite sides of the partition structure into adjacent partition cells for partial engagement of the tab beneath at last a portion of adjacent bottles contained in the carrier in cells adjacent to the elongated longitudinal partition structure.

2. The partition as defined in claim 1 further comprising the partition having formed thereon at last three downwardly extending feet and a hinged tab is formed on the middle foot.

3. The partition as defined in claim 1 further comprising the hinged tab being formed in a generally U-shaped configuration having two depending legs designed for positioning under the beverage bottle above the depending legs and further having a remaining portion designed for positioning under the beverage bottle above the remaining portion, the two depending legs and the remaining portions serving as a fixed wedge for positioning under adjacent beverage bottles in the carrier thereby preventing unfolding of the wedge with vibration or movement of the carrier.

4. The partition as defined in claim 3 further comprising a hinged tab being centrally located on the bottom edge of the partition structure.

5. A bottle carrier package comprising the combination of an outer enclosed wrap-around portion formed around an enclosed insertable vertical abbreviated height partition designed for containing a plurality of bottles positioned in adjacent cells of the carrier, the partition comprising:

(a) an elongated longitudinal partition structure having at least two hinged transverse partition elements formed therein; and (b) a hinged tab formed on the bottom edge of the elongated longitudinal partition structure and extending on opposite sides of the partition structure into adjacent partition cells for partial engagement of the tab beneath at last a portion of adjacent bottles contained in the carrier in cells adjacent to the elongated longitudinal partition structure.

6. The bottle carrier package as defined in claim 5 further comprising the hinged tab being formed in a generally U-shaped configuration having two depending legs designed for positioning under the beverage bottle above the depending legs and further having a remaining portion designed for positioning under the beverage bottle above the remaining portion, the two depending legs and the remaining portions serving as a fixed wedge for positioning under adjacent beverage bottles in the carrier thereby preventing unfolding of the wedge with vibration or movement of the carrier.

* * * * *